United States Patent [19]

Halfon

[11] 3,956,785

[45] May 18, 1976

[54] MULTIPURPOSE BOAT, STEERING AND MANEUVERING DEVICE THEREFOR, AND CLEAT DEVICE

[76] Inventor: Leon Halfon, 3625 S. Winter Canyon Road, Malibu, Calif. 90265

[22] Filed: Mar. 20, 1975

[21] Appl. No.: 560,250

[52] U.S. Cl. ..... 9/6 P; 114/39; 114/218

[51] Int. Cl.[2] ..... B63B 3/00; B63B 21/04

[58] Field of Search ..... 114/39, 56, 89–101, 114/201 R, 218; 9/1 R, 6; 24/115 R, 115 J, 130

[56] References Cited

UNITED STATES PATENTS

| | | | |
|---|---|---|---|
| 435,926 | 9/1890 | Frostad | 114/98 |
| 3,191,200 | 6/1965 | Fournillier | 9/6 |
| 3,310,017 | 3/1967 | Dyer | 114/98 |
| 3,422,778 | 1/1969 | Halfon | 9/6 |
| 3,812,811 | 5/1974 | Rodriguez | 114/218 |
| 3,834,340 | 9/1974 | Thorpe | 114/201 R |

*Primary Examiner*—Trygve M. Blix
*Assistant Examiner*—Jesus D. Sotelo
*Attorney, Agent, or Firm*—Thomas A. Fournie

[57] ABSTRACT

A multipurpose boat has a central cavity formed therein; a lid for closing the cavity; transverse grooves formed in the top surface and aligned grooves formed in the lid, the grooves functioning to strengthen the boat and being curved to discharge water; and elastic cord mechanism associated with the grooves for securing the lid closed. The boat top surface further is strengthened by longitudinal supports secured to its underside. A mast for the boat has a goose neck fitting associated therewith for rotatably mounting a sail carrying boom thereon. A combination of a tiller carrying a cleat device is provided for steering and maneuvering the boat when rigged with a sail. The cleat device defines an outwardly opening V-shaped slot with rope gripping walls for holding a rope set therein. The cleat rearward portion adjacent the slot exit slopes or curves forwardly and downwardly to provide a surface around which a rope inserted in the cleat slot may be pulled to set the rope therein. The cleat may be made of a rigid, yet resilient material to permit the setting of a rope deeply and tightly in the cleat slot.

44 Claims, 13 Drawing Figures

MULTIPURPOSE BOAT, STEERING AND MANEUVERING DEVICE THEREFOR, AND CLEAT DEVICE

BACKGROUND OF THE INVENTION

The present invention relates to boats.

More particularly, the present invention relates to multipurpose boats of the general type disclosed in the inventor's prior U.S. Pat. No. 3,422,778 issued on Jan. 21, 1969. Such multipurpose boats are suitable for being paddled, rigged as a sailboat, arranged for use with an outboard motor and/or used like a surfboard.

The present invention also relates to mechanism suitable for steering and maneuvering such boats when rigged with a sail as well as a cleat device usable thereon.

SUMMARY OF THE INVENTION

It is an object of the present invention to provide a multipurpose boat of the general type disclosed in U.S. Pat. No. 3,422,778 which is characterized by being sturdy, lightweight and of improved, simplified construction.

It is also an object of the present invention to provide an improved arrangement for rotatably mounting a sail carrying boom and boat mast which is particularly suited for use on multipurpose boats.

It is further an object of the present invention to provide improved mechanism for steering and maneuvering sail carrying boats, such as multipurpose boats rigged with a sail.

It is additionally an object of the present invention to provide an improved cleat suitable for use on boats, such as multipurpose boats.

In accomplishing these and other objects, there is provided in accordance with the present invention a multipurpose boat of the general type disclosed in U.S. Pat. No. 3,422,778 having transverse grooves formed in its top surface which significantly enhance the boat's structural strength so as to permit simplification of its construction.

Further, longitudinal supports may be secured along the underside of the boat top portion to increase structural strength. A central cavity is formed in the boat which is suitable for use, for example, as a storage space and a lid is provided for closing the cavity in a substantially watertight seal. Longitudinal supports made of buoyant material may be secured along the underside of the lid to increase structural strength and make the lid buoyant. The boat's top surface, the transverse grooves therein, and the lid are curved so that water flowing thereacross is collected by the grooves and discharged thereby along the sides of the boat.

Grooves are also formed in the lid in alignment with the adjacent transverse grooves in the boat's top surface. Elastic cord mechanism for securing the lid closed is associated with the aligned grooves, the elastic cords thereof fitting within the grooves in a safe, out of the way position substantially flush with the boat's top surface.

An arrangement is provided for rotatably mounting a mast on the boat and a goose neck fitting device is associated with the mast for rotatably securing a sail carrying boom thereon. A tiller-cleat combination is provided for steering and maneuvering the boat when rigged with a sail, the cleat being carried by the tiller.

The cleat provided has an outwardly opening V-shaped slot for gripping and holding a rope or line set therein. The bottom of the slot may slope from its entrance towards its exit, the level of the slot entrance being raised relative to its exit. Forwardly and downwardly slanting rope gripping ridges are formed along the slot walls. The rearward portion of the cleat adjacent the slot exit slopes or curves forwardly and downwardly to provide an extendedly positioned slot exit edge surface around which a rope may be pulled to set the rope therein. Further, at least the portion of said cleat defining said V-shaped slot is preferably made of a rigid, yet resilient material so that when a rope is set therein the V-shaped slot springs open slightly. Thereby, the rope may be set deeply and tightly in the cleat slot.

Additional objects of the present invention reside in the specific construction of the exemplary embodiments hereinafter described.

DETAILED DESCRIPTION OF THE PREFERRED EMBODIMENT

Figure 1:
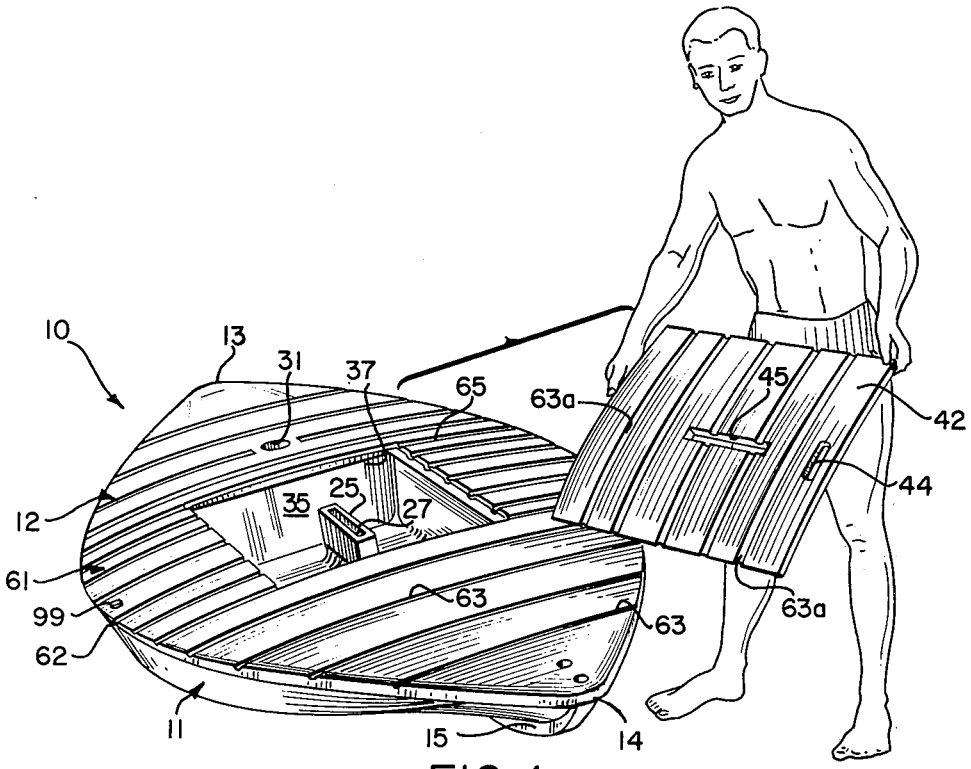
FIG. 1 is a perspective view of an improved multipurpose boat according to the present invention.
Figure 8:
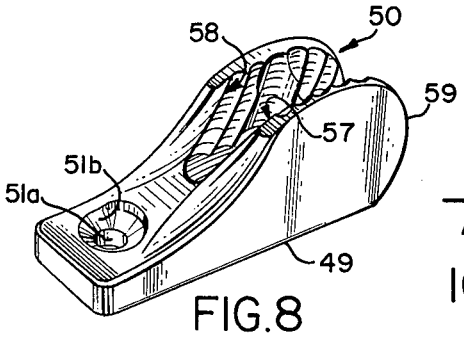
FIG. 8 is a perspective view of the cleat according to the present invention incorporated in the tiller-cleat combination of FIG. 7.
Figure 9:
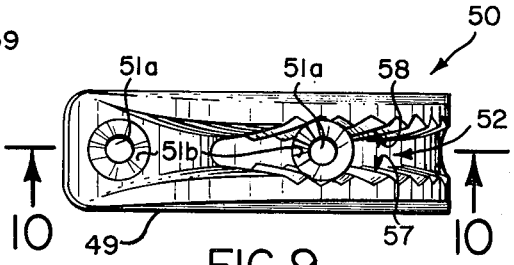
FIG. 9 is a top view of the cleat of FIG. 8.
Figure 10:
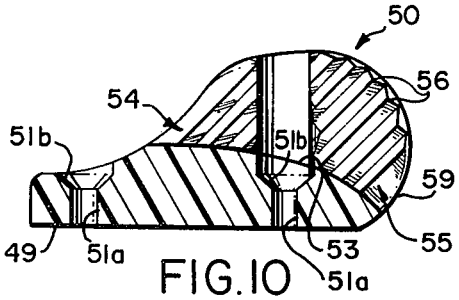
FIG. 10 is a side cross-sectional view of the cleat of FIG. 8.
Figure 11:
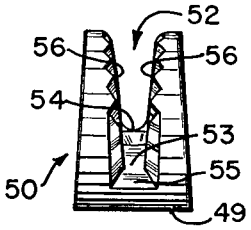
FIG. 11 is a rear view of the cleat of FIG. 8.

Referring to the drawings in more detail, there is shown in FIGS. 1–5 a multipurpose boat having an elongated buoyant body portion generally identified by the numeral 10. The outer shape of the body portion 10 conforms substantially to that of the multipurpose boat shown and described in the inventor's U.S. Pat. No. 3,422,778. The portions of U.S. Pat. No. 3,422,778 illustrating and describing the outer shape of the boat's body are hereby incorporated herein by reference. Further, for clarity, a brief description of the shape of the boat's body is reiterated herein.

The body 10 illustrated is made up of a hull piece 11 and a top or deck piece 12. The pieces 11 and 12 may be made in any suitable manner, but preferably are separately molded from a suitable plastic material, such as foam polyurethane. Assembled the hull 11 and deck 12 define a body 10 having a bow 13, a stern 14, a keel member 15 dividing the hull bottom into a starboard portion 16 and port portion 17, a starboard side 18 and a port side 19.

The body 10 illustrated is symmetrical in its longitudinal dimension, i.e. about a vertical transverse plane extending midway between its bow and stern, and also in its transverse dimension, i.e. about a vertical longitudinal plane extending through its bow and stern. The boat's bow 13 and stern 14 are each defined in similar pointed configurations by forming the exterior of the keel 15; the bottom portions 16, 17; and the sides 18, 19 in convex shapes which extend therebetween. Further, the sides 18, 19 preferably extend upwardly from the bottom portions 16, 17 in a slightly outward slant.

Figure 5:
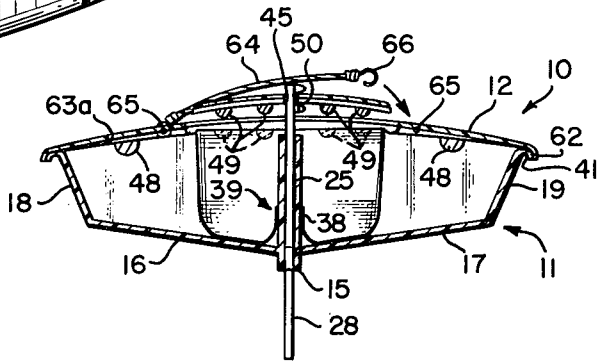
FIG. 5 is a view taken along the line 5—5 of FIG. 4.
Figure 3:
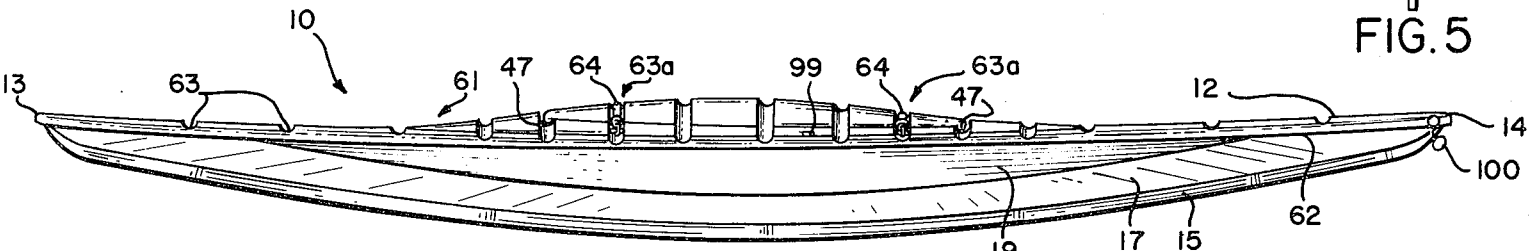
FIG. 3 is a side view of the boat of FIG. 1.
Figure 4:
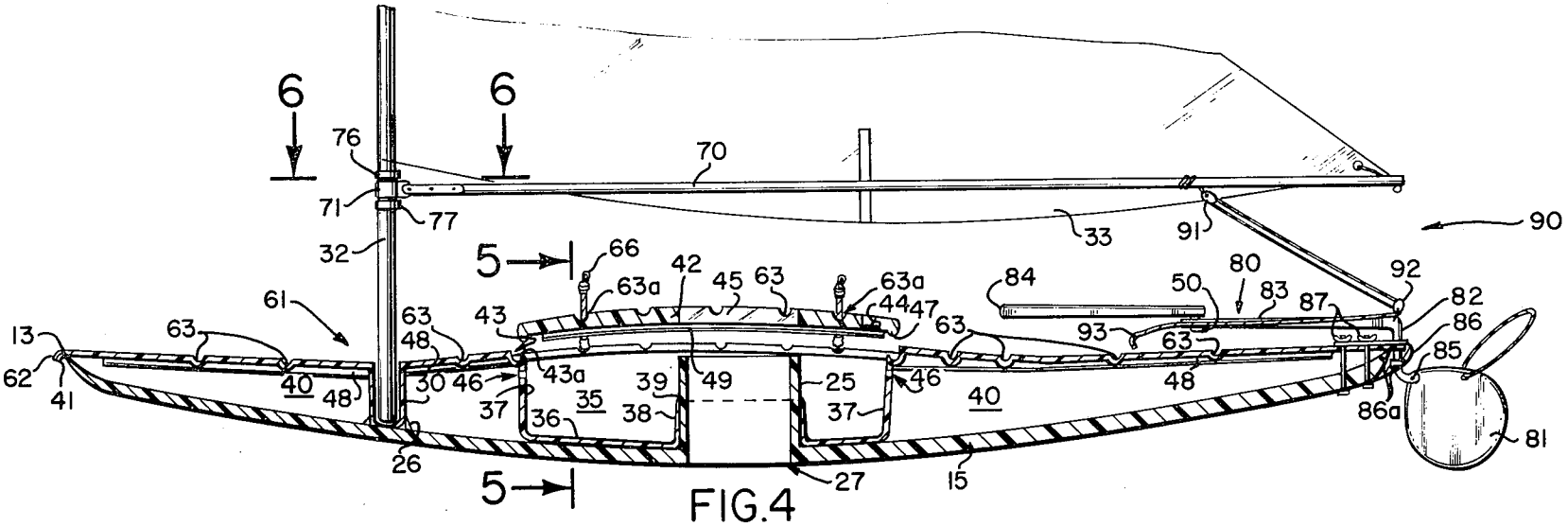
FIG. 4 is a side cross-sectional view of the boat of FIG. 1 shown rigged with a sail and a tiller-cleat steering combination in accordance with the present invention.

As shown in FIGS. 4 and 5, the hull 11 is molded to include on its inner surface centerboard support structure 25 and a socket 26. The centerboard support structure 25 extends upwardly from the keel member 15 in the plane of the boat's longitudinal axis and is positioned substantially centrally between the bow 13 and stern 14. The length of the centerboard support structure 25 is slightly less than the depth of the central portion of the boat body 10 so as to extend to a point just below the top piece 12. The centerboard support structure 25 defines a vertical slot 27 for receiving the boat's centerboard 28, shown in FIG. 12. The slot 27 extends through the keel member 15, thereby opening in the bottom of the boat 10.

The socket 26 is located on the inner surface of the hull 11 along the boat's longitudinal center plane at a position substantially midway between the bow 13 and the boat's transverse center plane. The socket 26 is designed for receiving and supporting an interfitting mast support structure 30.

As shown in FIG. 4, the boat top piece 12 is molded to include on its inner surface the mast support structure 30. The mast support structure 30 depends downwardly from the top piece 12 and interfits within the socket 26 so as to be laterally supported and held in place thereby in a substantially watertight seal therewith. The support structure 30 defines a vertically extending bore 31 for receiving the mast 32 of sail 33. The bore 31 opens in the deck surface defined by the upper side of the boat top piece 12 at a point along the boat's longitudinal center plane.

The boat top piece 12 is molded to also include a centrally located, preferably rectangularly shaped, upwardly opening cavity 35. The cavity 35 has a floor surface 36 and side wall surfaces 37. The floor surface 36 has an upwardly projecting slot defining collar portion 38 formed thereon which fits around and thus supports the centerboard support structure 25. The centerboard support structure 25 extends through this collar structure 38 and a watertight seal is formed at the elevated junction 39 between the support structure 25 and the collar structure 38 to prevent any discharge of water from the cavity 35 into the boat's hull cavity 40.

The cavity 35 may be used for storage or any other suitable use, and its floor portion 36 is preferably formed as rounded halves, as shown in FIG. 5, suitable for receiving air diving tanks. The rounded construction of the floor portion 36 also adds to the structural strength of the collar structure 38.

The boat's hull cavity 40 is formed to be substantially watertight by securing the top piece 12 on the hull 11 in a substantially watertight seal. The watertight seal is preferably accomplished by forming the top edge 41 of the hull 11 as a rounded downwardly opening groove and the outer edge 62 of the top piece 12 as a rounded surface which fits over the hull edge 41. The edge portions 41 and 62 may be sealed together by placing a suitable adhesive therebetween and then clamping them tightly together. Further, the edge portion 41 provides a hand grip along the edge of the boat.

The cavity 40 is preferably left hollow and very small air vent holes 46 are formed in the forward and after cavity walls 37 to permit air pressure equalization without the passage of water therethrough. If desired, the cavity 40 could be filled with a suitable ballast material prior to sealing the top piece 12 on the hull 11.

A lid 42 for covering and closing the rectangular opening of the storage cavity 35 is shown in FIGS. 1–5. Ledge structure 43 is formed around the rim of the storage cavity 35 which mates with a rim 47 along the lower edge of the lid 42 to support the lid 42 in a closed position flush with the top surface of the boat body 10. The ledge 43 includes an upwardly extending lip **43*a* which defines a groove into which the rim 47 on the lid 42 fits. With the lid 42 in place, the lip 43*a* defines a barrier which prevents the flow of water into the cavity 35. A transversely extending upwardly opening cavity 44 is formed in the lid adjacent one of its ends. The cavity 44 provides a handle or grip for removing the lid 42 to open the storage cavity 35. A longitudinal slot 45 is formed in the lid 42 above and in alignment with the centerboard support structure 25. The slot 45 is dimensioned so that the centerboard 28 may be inserted therethrough into the slot 27 of the centerboard support structure 25. The centerboard 28 is shown so inserted in situ in FIG. 5. Longitudinal supports 49 may be secured on the underside of the lid 42 to increase structural strength. The supports 49 are preferably formed of buoyant material, such as a non-liquid absorbing foam, to make the lid 42** buoyant.

Figure 12:
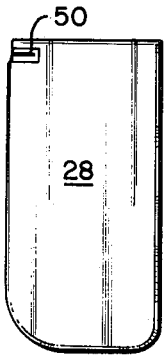
FIG. 12 is a side view of the cleat carrying boat centerboard of FIG. 5.
Figure 13:
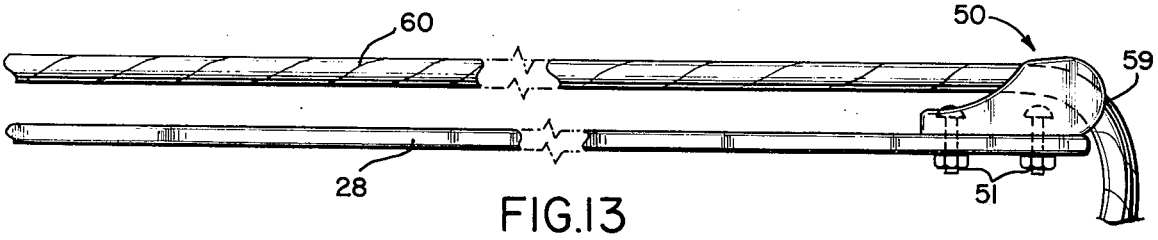
FIG. 13 is a top view of the centerboard of FIG. 12.

As shown in FIGS. 5, 12 and 13, a cleat 50 is attached near the upper front corner of the centerboard 28. The cleat 50 is preferably attached to the centerboard 28 by means of bolts 51.

The specific construction of the cleat 50 is described hereinafter in detail. The cleat 50 on the centerboard 28 functions as a jamb cleat or stop which prevents the centerboard 28 from falling through the slot 27 out the bottom of the hull 11. The cleat 50 is shown in FIG. 13 holding and gripping a rope or line 60.

The upper surfaces of the top piece 12 and lid 42 provide the boat's deck surface 61. Preferably the deck surface 61 slopes arcuately downwardly from the boat's longitudinal center plane to its side edges 62 so that water drains therefrom even when the boat is perfectly stable. Further, longitudinal supports 48 are preferably secured, e.g. adhesively, along the underside of the top piece 12 to reinforce the deck surface 61 defined thereby. The supports 48 are preferably made of a buoyant material, such as non-liquid absorbing foam.

Formed in the deck surface 61 at selected spaced apart intervals along the length of the boat body 10 are transverse grooves 63. The grooves 63 illustrated are of uniform depth along their length and thus have approximately the same curvature as the curved deck surface 61. The grooves 63 function to collect water or waves flowing across the boat's deck surface 61 and operate to discharge this collected water along the sides of the boat. Further, the presence of the grooves 63 in the top piece 12 significantly enhances the structural strength of the boat body 10, thereby eliminating the need for transverse supports along the length of the boat. Also, the grooves 63 inherently provide grip structure which helps a person standing on the deck structure 61 to maintain footing.

Two of the transverse grooves 63 have elastic bungi cords 64 associated therewith. These grooves are designated 63*a* to distinguish them from the others and extend across opposite ends of the lid 42 with the groove portions in the top piece 12 and lid 42 being aligned.

Figure 2:
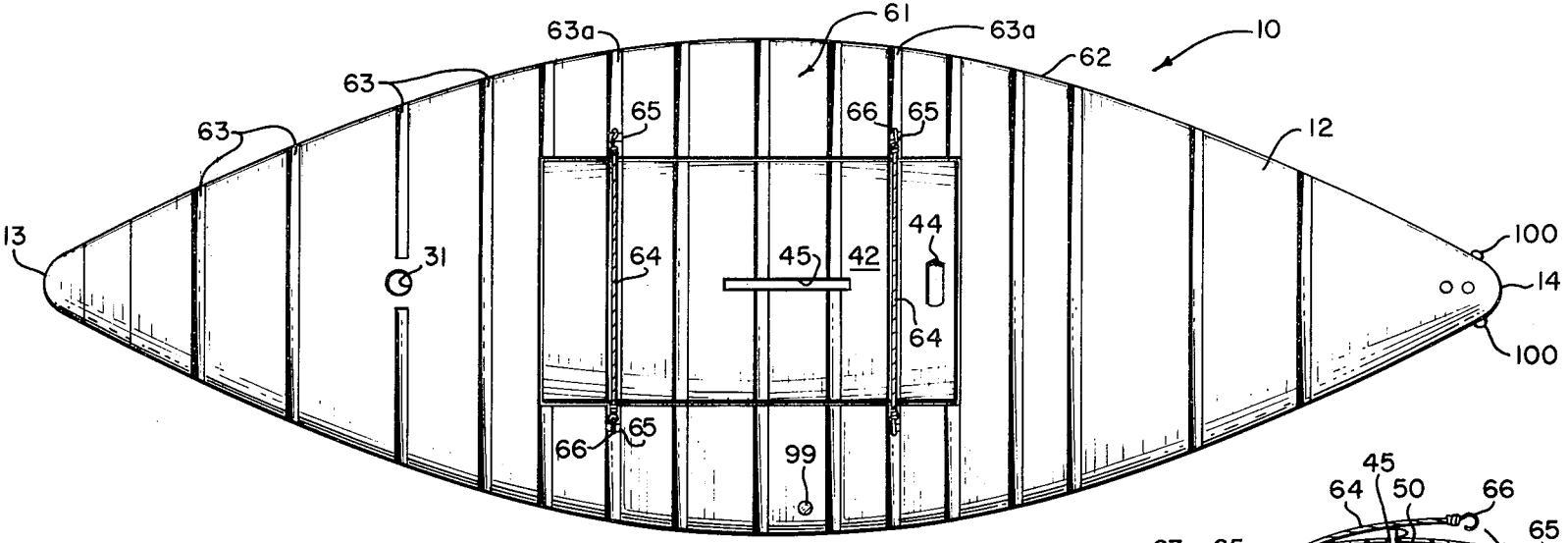
FIG. 2 is a top view of the boat of FIG. 1.

Secured across the grooves 63*a* at selected distances outwardly from the side edges of the lid 42 are pins 65. Hooks 66 are secured on the ends of the elastic cords 64 for hooking over the pins 65. The unstretched lengths of the cords 64 are dimensioned to be a predetermined distance shorter than the distance along the respective grooves 63*a* between the pins 65. By stretching the cords 64 along the grooves 63*a* and hooking the hooks 63 thereon on the pins 65, the cords 64 are held taut across opposite ends of the lid 42 to secure the lid 42 closed, as shown in FIG. 2. As shown in FIG. 1, the cords 64 lay in the grooves 63*a* in safe out of the way positions substantially flush with the deck surface 61.

In FIGS. 4 and 5, the cords 64 and 65 are illustrated being stretched into place by being first hooked on one of the pins 65 in each of the grooves 63*a* and then stretched across the lid 42. The lid 42 may be easily opened by unhooking the cords 64 and lifting the lid up by use of the handle 44.

Referring to FIG. 4, the multipurpose boat is there shown rigged with the sail 33. The mast 32 associated with the sail has its lower end positioned in the mast support structure 30. The sail 33 is triangular in shape and the mast 32 extends through a vertical hem of the sail.

Rotatably mounted on the mast 32 to extend substantially horizontally therefrom through a hem in the bottom of the sail 33 is a boom 70. The boom 70 is rotatably mounted on the mast 32 by positioning a goose neck fitting 71 around the mast 32 and pivotally connecting the boom to the open ends 71*a* of the goose neck fitting by means of a bolt 72. The bolt 72 defines a substantially horizontally extending pivot axis.

The bolt 72 extends between boom attached mounting plates 73 through holes therein which are aligned with bolt receiving holes in the goose neck fitting ends 71*a*. The mounting plates 73 are bolted to the boom 70 and extend longitudinally from the inner end thereof in a substantially parallel disposition. The ends 71*a* of the goose neck fitting 71 fit within the mounting plates 73 and are held apart in a substantially parallel disposition by a spacer 74. The spacer 74 is a cylindrical element having a central bore through which bolt 75 is inserted to bolt the spacer 74 in place between the goose neck fitting ends 71*a*.

Figure 6:
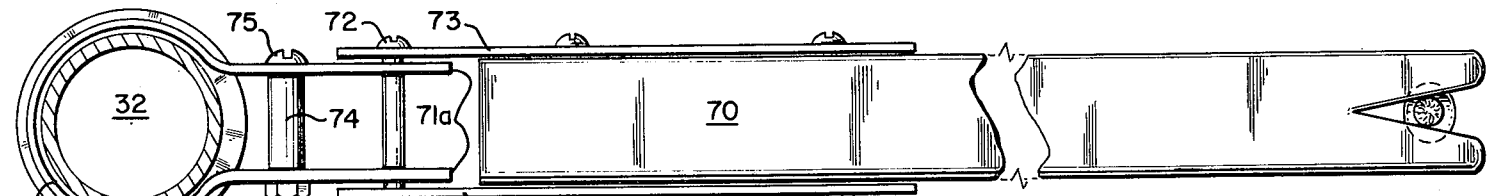
FIG. 6 is a view taken along the line 6—6 of FIG. 4.

With the spacer 74 in situ, the inner diameter of the curved portion 71*b* of the goose neck fitting 71 is larger than the outer diameter of the mast 32 so as to loosely fit therearound as shown in FIG. 6.

The goose neck fitting 71 is held vertically in place on the mast 32 by means of the upper and lower set rings or stops 76 and 77, respectively, which are secured in fixed positions on the mast 32.

As shown in FIG. 4, the lower end of the mast 32 is free to rotate in the mast support structure 30. Accordingly, it would appear at first glance that there is no need to rotatably secure the boom 70 thereon. However, through experimental use of a multipurpose boat constructed in accordance with the present invention, it has been found that sand and other debris frequently collects in the bore defined by the mast support structure 30 and that this debris hinders and prevents rotation of the mast 32 therein. Further, it may be desired to detachably lock the mast 32 in the support structure 30.

Figure 7:
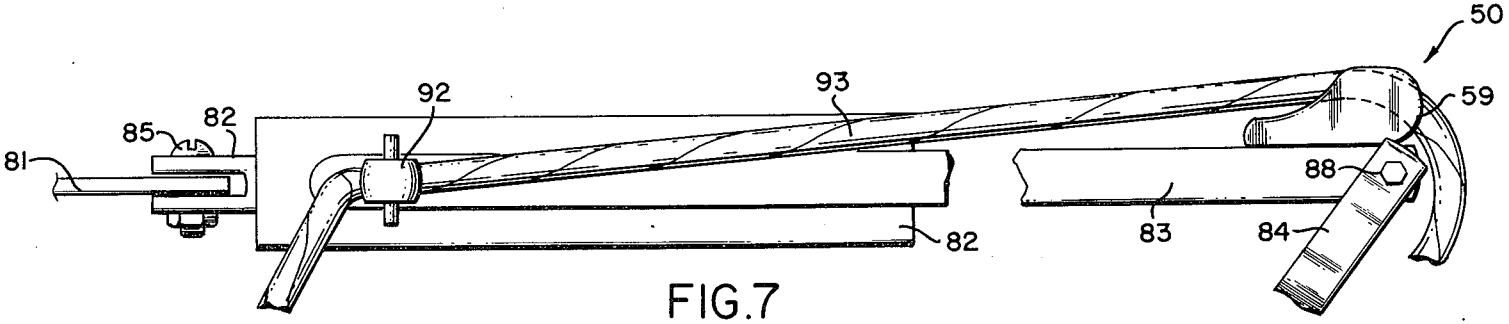
FIG. 7 is a top view of the tiller-cleat combination of FIG. 4.

A combination of a tiller 80 carrying one of the cleats 50 is shown in FIG. 4 for steering and maneuvering the boat when rigged with a sail. The tiller mechanism 80 includes a rudder 81, a rudder carrying arm 82, a steering arm 83 and an extension arm 84. As shown in FIGS. 4 and 7, the rudder is pivotally mounted on the lower end of arm 82 by bolt 85 to pivot automatically upwardly into a stored position whenever the boat is beached. The rudder carrying arm 82, which is shaped like a crank arm, is mounted on the boat by means of a bracket 86 to pivot about a vertical axis. Vertically spaced apart sleeves 86*a* are included in the bracket arrangement 86 through which the rudder arm 82 extends. The sleeves 86*a* are preferably made of plastic and prevent vertical movement of the rudder arm 82 while providing bearing surfaces for rotation of the arm 82 relative to the bracket 86. The bracket 86 is bolted on the boat by bolts 87. The tiller extension arm 84 is bolted to the end of the steering arm 83 remote from the rudder 81 by bolt 88. By rotating the arm 84 horizontally to the position shown in FIG. 4 and tightening the bolt 88, the arm for steering the rudder 81 may be conveniently lengthened.

Rigged in a conventional manner for controlling the position of the sail 33 is a rope and pulley set 90 made up of pulleys 91, 92 and a rope 93. The pulley 91 is secured on the boom 70 while the pulley 92 is secured on the rudder support arm 82 adjacent the rudder 81. By pulling on or releasing the rope 93, the position of the sail 33 may be shifted.

The cleat 50 is mounted at the end of the steering arm 83 remote from the rudder 81, preferably on one side thereof. The cleat 50 is designed to receive the rope 93 and operates to grip and hold the rope 93 when the rope is set therein, thereby the sail 33 may be set in a selected disposition. As hereinafter described, the cleat 50 is designed so that a person sailing the boat and steering the tiller arm 83 may with one hand easily set the rope 93 therein or release it therefrom. Thus, the combination of the tiller mechanism 80 carrying the cleat 50 enables a single individual to easily control the rudder 81 and sail 33 simultaneously.

The cleat 50 itself is shown in greater detail in FIGS. 8–11. The cleat 50 has an outwardly opening V-shaped slot 52 for gripping and holding a rope or line set therein. The cleat 50 also has a base 49 which defines a flat mounting surface. The slot 52 opens in a direction perpendicularly away from the flat mounting surface of the base 49. The bottom 53 of the slot 52 is illustrated sloping from its entrance 54 towards its exit 55, the level of the slot entrance 54 being raised relative to its exit 55. Forwardly and downwardly slanting rope gripping ridges 56 are formed along the slot walls 57, 58. The ridges 56 are illustrated as being mutually parallel. Preferably, the rearward portion 59 of the cleat adjacent the slot exit slopes or curves forwardly and downwardly to provide a convex surface and positioned slot exit edge surface over and around which a rope may be pulled, such as in the manner shown in FIG. 13, to set the rope therein.

Longitudinally spaced apart bore holes 51*a* are formed through the base of the cleat 50 for receiving the bolts 51, as shown in FIG. 13. The upper ends of the bore holes 51*a* define recesses 51*b* for receiving the bolt heads, thereby the bolt heads are positioned below the level of the groove bottom 53 out of the path of a rope set therein.

A rope may be set in one of the cleats 50 by placing it in the V-shaped slot 52 and pulling it around the rear cleat portion 59. Pulling the rope around the rear cleat portion 59 pulls the rope into the slot 52 to tightly set it therein. The rope may be easily removed from the cleat 50 by placing tension thereon and pulling outwardly and away from the slot 52. Thus, the operations of setting a rope in the cleat 50 and selectively removing it therefrom may be easily performed with one hand. The cleat 50 is preferably made of a rigid, yet resilient, material which springs open slightly when a rope is pulled into the slot 52. Thereby, the rope may be set deeply and tightly in the slot 52. For example, the cleats 50 may be made by being cast from a two component liquid mixture commonly called CAST-TECH which is obtainable from Vagabond Industries in San Diego, Calif. The CAST-TECH mixture cures at ambient temperatures to form a plastic type of material the rigidity and resilience of which is selectively controllable by controlling the relative proportions of its two liquid components.

It is noted that a bracket arrangement similar to that shown for mounting the tiller mechanism 80 could be used for securing an outboard motor mount on the stern 14. Also, a drain plug 99, as shown in FIG. 2, may be mounted in the boat body 10 to permit water to be drained therefrom.

Thus, there has been provided an improved lightweight and sturdy multipurpose boat suitable for being paddled, rigged as a sailboat, arranged for use with an outboard motor and/or used like a surfboard. Also improved mechanism suitable for steering and maneuvering the boat when rigged with a sail has been provided as well as an improved cleat device usable thereon.

Although I have herein shown and described my invention in what I have conceived to be the most practical and preferred embodiment, it is recognized that departures may be made therefrom within the scope of my invention.

I claim:

1. A multipurpose boat having an elongated substantially hollow buoyant body, said body having a bow and stern and being substantially symmetrical about both its vertical transverse center plane and its vertical longitudinal center plane, said bow and stern each being formed to have a substantially pointed configuration, said body being formed by a hull piece and a top piece, said top being supported by the upper peripheral edge of said hull, said top having transverse grooves formed in and across its upper surface which enhance said boat's structural strength, said boat including:

means for forming mast support structure as a part of said top, said mast support structure depending downwardly from said top; and means defining a socket on the inside surface of said hull for receiving said mast support structure to provide lateral support therefor.

2. The invention defined in claim 1, wherein the upper surface of said top and said transverse grooves formed therein slope downwardly from the vertical longitudinal center plane of said boat to the side edges of said top whereby water flowing across the deck defined by the upper surface of said top is collected by said transverse grooves and discharged thereby along the sides of said boat.

3. The invention defined in claim 2, including at least one longitudinal support secured out of contact with said hull along the underside of said top to reinforce said top.

4. The invention defined in claim 1, including at least one longitudinal support secured out of contact with said hull along the underside of said top to reinforce said top.

5. The invention defined in claim 1, including at least one longitudinal support secured out of contact with said hull along the underside of said top on opposite sides of the vertical longitudinal center plane of said boat to reinforce said top.

6. The invention defined in claim 1, including said top being formed to define a central upwardly opening cavity in said boat.

7. The invention defined in claim 6, including:

a lid for closing said cavity; and structure for supporting said lid in a substantially flush relationship with the upper surface of said top to close said cavity.

8. The invention defined in claim 7, including:

at least one of said transverse grooves formed to extend across said lid;

an elastic cord associated with said transverse groove formed across said lid; and means associated with said cord and its associated one of said transverse grooves for detachably securing said cord in said groove in a stretched position across said lid to hold said lid closed.

9. The invention defined in claim 8, wherein:

two of said transverse grooves are formed across said lid, one of said grooves being positioned adjacent the forward end of said lid and the other of said grooves being positioned adjacent the after end thereof;

one of said elastic cords is associated with each of said transverse grooves formed across said lid; and means are associated with each of said cords and its associated one of said transverse grooves for detachably securing said cords in said grooves in stretched positions across said lid to hold said lid closed.

10. The invention defined in claim 9, wherein the upper surface of said top, said lid and said transverse grooves formed therein slope downwardly from the vertical longitudinal center plane of said boat to the side edges of said top.

11. The invention defined in claim 1, including:

means for defining centerboard support structure as a part of said hull, said centerboard support structure extending upwardly from said hull.

12. The invention defined in claim 11, including said top being formed to define a central upwardly opening cavity in said boat, said centerboard support structure extending upwardly through the bottom of said cavity, said cavity bottom including collar structure formed to extend upwardly around said centerboard support structure to support said centerboard support structure and substantially prevent the flow of water therebetween.

13. The invention defined in claim 12, including: a centerboard for fitting in said centerboard support structure to extend from the bottom of said hull; and a lid for closing said cavity and an opening formed in said lid in alignment with said centerboard support structure, said lid opening being dimensioned to receive said centerboard whereby said centerboard may be inserted into said centerboard support structure therethrough.

14. The invention defined in claim 1, including:

a mast;

a sail carrying boom;

means for mounting said mast on said boat to extend upwardly therefrom; and means for rotatably mounting said boom on said mast.

15. The invention defined in claim 14, wherein said means for mounting said mast on said boat comprises cylindrical bore means for receiving the lower end of said mast, said mast having a cylindrical lower end dimensioned to fit in said bore means to be freely rotatable therein.

16. The invention defined in claim 14, wherein said means for rotatably mounting said boom on said mast includes a goose neck fitting having open ends held horizonally apart by a spacer dimensioned to maintain the inner diameter of said goose neck fitting larger than the outer diameter of said mast whereby said goose neck fitting is freely rotatable on said mast.

17. The invention defined in claim 16, including:

means for pivotally mounting said boom on the open ends of said goose neck fitting for pivotal movement about a substantially horizontally extending pivot axis; and means for holding said goose neck fitting vertically in place on said mast.

18. The invention defined in claim 1, including:

a sail mounted on said boat;

rudder means for steering said boat including a steering arm for controlling the position of said rudder;

rope-pulley means associated with said sail and steering arm for selectively controlling the position of said sail; and a cleat mounted on said steering arm for receiving the rope of said rope-pulley means, said cleat being operable to hold said rope, said cleat having a base and defining a substantially V-shaped slot opening outwardly from said base, said slot having an entrance and exit portion, the exterior portion of said cleat adjacent said slot exit sloping forwardly from said slot exit towards said cleat base to provide and define a slot exit edge surface around and over which a rope may be pulled to set the rope therein, the walls of said slot having rope gripping ridges formed therein to slant forwardly and inwardly towards said base whereby said rope may be set in said cleat by being inserted in said slot and pulling thereon around and over said exterior cleat portion and slot exit edge surface and selectively removed therefrom by placing tension on said rope and pulling away from said slot.

19. The invention defined in claim 18, wherein at least the portion of said cleat defining said V-shaped slot is made of a rigid, yet resilient material to spring open when a rope is pulled into said slot whereby to permit a rope to be set deeply and tightly therein.

20. The invention defined in claim 18, wherein the bottom of said slot slopes from its entrance portion to its exit portion with the level of said slot entrance being raised relative to said slot exit.

21. The invention defined in claim 18, including:

said top formed to define a central upwardly opening cavity in said boat;

a lid for closing said cavity;

longitudinal supports made of buoyant material secured along the underside of said top and lid to enhance structural strength and buoyancy;

structure for supporting said lid in a substantially flush watertight relationship with the upper surface of said top to close said cavity;

at least one of said transverse grooves formed to extend across said lid;

an elastic cord associated with said transverse groove formed across said lid;

means associated with said cord and its associated one of said transverse grooves for detachably securing said cord in said groove in a stretched position across said lid to hold said lid closed;

the upper surface of said top, said lid and said transverse grooves formed therein sloping downwardly from the vertical longitudinal center plane of said boat to the side edges of said top;

means for defining centerboard support structure as a part of said hull, said centerboard support structure extending vertically upward from said hull through the bottom of said cavity, said cavity bottom including collar structure formed to extend upwardly around said centerboard support structure to support said centerboard support structure and substantially prevent the flow of water therebetween;

a mast carrying said sail rotatably fitted within said mast support structure to removably mount said sail on said boat;

a boom for said sail; and means for rotatably mounting said boom on said mast.

22. The invention defined in claim 21, wherein said hull is comprised of a keel member, starboard and port bottom portions, and starboard and port side portions all formed as convex surfaces extending between said bow and said stern, said side portions extending upwardly and outwardly from said bottom portions.

23. A cleat for receiving and holding a rope comprising structure defining a base and a substantially V-shaped slot opening outwardly from said base, said slot having an entrance and exit portion, the exterior portion of said cleat adjacent said slot exit sloping forwardly and downwardly from said slot exit towards said cleat base to provide and define a slot exit edge surface around and over which a rope may be pulled to set the rope therein, the walls of said slot having rope gripping ridges formed thereon to slant forwardly and inwardly towards said base whereby a rope may be set in said cleat by being inserted in said slot and pulling thereon around and over said exterior cleat portion and slot exit edge surface and selectively removed therefrom by placing tension on said rope and pulling away from said slot.

24. The invention defined in claim 23, wherein the bottom of said slot slopes from its entrance portion to its exit portion with the level of said slot entrance being raised relative to said slot exit.

25. The invention defined in claim 24, wherein said exterior surface of said cleat adjacent said slot exit is rounded.

26. The invention defined in claim 24, wherein the bottom of said slot between said entrance and exit portions is arcuate.

27. The invention defined in claim 26, wherein at least the portion of said cleat defining said V-shaped slot is made of a rigid, yet resilient material to spring open when a rope is pulled into said slot whereby to permit a rope to be set deeply and tightly therein.

28. The invention defined in claim 23, wherein:

the side of said cleat base away from said slot defines a substantially flat mounting surface; and said slot opens in a direction substantially perpendicular to and away from said mounting surface.

29. The invention defined in claim 23, wherein at least the portion of said cleat defining said V-shaped slot is made of a rigid, yet resilient material to spring open when a rope is pulled into said slot whereby to permit a rope to be set deeply and tightly therein.

30. The invention defined in claim 23, wherein the exterior surface of said cleat adjacent said slot exit is rounded.

31. A multipurpose boat having an elongated substantially hollow buoyant body, said body having a bow and stern and being substantially symmetrical about both its vertical transverse center plane and its vertical longitudinal center plane, said bow and stern each being formed to have a substantially pointed configuration, said body being formed by a hull piece and a top piece, said top being supported by the upper peripheral edge of said hull, said boat including:

means for forming mast support structure as a part of said top, said mast support structure depending downwardly from said top; and means defining a socket on the inside surface of said hull for receiving said mast support structure to provide lateral support therefor.

32. The invention defined in claim 31, including means for defining centerboard support structure as a part of said hull, said centerboard support structure extending upwardly from said hull.

33. The invention defined in claim 32, including said top being formed to define a central upwardly opening cavity in said boat, said centerboard support structure extending upwardly through the bottom of said cavity, said cavity bottom including collar structure formed to extend upwardly around said centerboard support structure to support said centerboard support structure and substantially prevent the flow of water therebetween.

34. The invention defined in claim 33, including:

a centerboard for fitting in said centerboard support structure to extend from the bottom of said hull; and a lid for closing said cavity and an opening formed in said lid in alignment with said centerboard support structure, said lid opening being dimensioned to receive said centerboard whereby said centerboard may be inserted into said centerboard support structure therethrough.

35. The invention defined in claim 31, wherein:

said mast support structure and socket define a cylindrical bore for receiving a mast; and including:

a mast having a cylindrical lower end dimensioned to fit in said cylindrical bore to be freely rotatable therein;

a sail carrying boom; and means for rotatably mounting said boom on said mast.

36. The invention defined in claim 35, wherein said means for rotatably mounting said boom on said mast is a goose neck fitting means.

37. A multipurpose boat having an elongated substantially hollow buoyant body, said body having a bow and stern and being substantially symmetrical about both its vertical transverse center plane and its vertical longitudinal center plane, said bow and stern each being formed to have a substantially pointed configuration, said body being formed by a hull and a top, said top having transverse grooves formed in and across its upper surface, said boat including:

said top being formed to define a central upwardly opening cavity in said boat:

a lid for closing said cavity;

structure for supporting said lid in a substantially flush relationship with the upper surface of said top to close said cavity;

at least one of said transverse grooves formed to extend across said lid;

an elastic cord associated with said transverse groove formed across said lid; and means associated with said cord and its associated one of said transverse grooves for detachably securing said cord in said groove in a stretched position across said lid to hold said lid closed.

38. The invention defined in claim 37, wherein:

two of said transverse grooves are formed across said lid, one of said grooves being positioned adjacent the forward end of said lid and the other of said grooves being positioned adjacent the after end thereof;

one of said elastic cords is associated with each of said transverse grooves formed across said lid; and means are associated with each of said cords and its associated one of said transverse grooves for detachably securing said cords in said grooves in stretched positions across said lid to hold said lid closed.

39. The invention defined in claim 38, wherein the upper surface of said top, said lid and said transverse grooves formed therein slope downwardly from the vertical longitudinal center plane of said boat to the side edges of said top.

40. The invention defined in claim 37, wherein the upper surface of said top, said lid and said transverse grooves formed therein slope downwardly from the vertical longitudinal center plane of said boat to the side edges of said top.

41. In a multipurpose boat having an elongated substantially hollow buoyant body, said body having a bow and stern and being substantially symmetrical about both its vertical transverse center plane and its vertical longitudinal center plane, said bow and stern each being formed to have a substantially pointed configuration, the improvement of maneuvering and steering means comprising:

a sail mounted on said boat;

rudder means for steering said boat including a steering arm for selectively controlling the position of said rudder;

rope-pulley means associated with said sail and steering arm for selectively controlling the position of said sail; and a cleat mounted on said steering arm for receiving the rope of said rope-pulley means, said cleat being operable to hold said rope, said cleat having a base and defining a substantially V-shaped slot opening outwardly from said base, said slot having an entrance and exit portion, the exterior portion of said cleat adjacent said slot exit sloping forwardly and downwardly from said slot exit towards said cleat base to provide and define a slot exit edge surface around and over which a rope may be pulled to set the rope therein, the walls of said slot having rope gripping ridges formed therein to slant forwardly and inwardly towards said base whereby said rope may be set in said cleat by being inserted in said slot and pulling thereon around and over said exterior cleat portion and slot exit edge surface and selectively removed therefrom by placing tension on said rope and pulling away from said slot.

42. The invention defined in claim 41, wherein at least the portion of said cleat defining said V-shaped slot is made of a rigid, yet resilient material to spring open when a rope is pulled into said slot whereby to permit a rope to be set deeply and tightly therein.

43. The invention defined in claim 41, wherein the bottom of said cleat slot slopes from its entrance to its exit portion with the level of said slot entrance being raised relative to said slot exit.

44. The invention defined in claim 43, wherein at least the portion of said cleat defining said V-shaped slot is made of a rigid, yet resilient material to spring open when a rope is pulled into said slot whereby to permit a rope to be set deeply and tightly therein.

* * * * *